US007151458B2

(12) United States Patent
Randolph

(10) Patent No.: US 7,151,458 B2
(45) Date of Patent: Dec. 19, 2006

(54) DISCREET BED-WETTING ALARM AND METHOD OF USE THEREOF

(76) Inventor: Anna Randolph, 6703 Biscayne Blvd., Rex, GA (US) 30273

( * ) Notice: Subject to any disclaimer, the term of this patent is extended or adjusted under 35 U.S.C. 154(b) by 150 days.

(21) Appl. No.: 10/924,472

(22) Filed: Aug. 24, 2004

(65) Prior Publication Data

US 2006/0044143 A1 Mar. 2, 2006

(51) Int. Cl.
*G08B 23/00* (2006.01)

(52) U.S. Cl. ..... 340/573.5; 340/604; 340/691.1; 340/384.4; 340/384.71; 340/331; 340/815.4

(58) Field of Classification Search ..... 340/573.5, 340/604, 691.1, 691.6, 691.4, 691.5, 692, 340/384.71–3, 384.4, 815.4, 331, 407.1, 340/309.6–309.9

See application file for complete search history.

(56) References Cited

U.S. PATENT DOCUMENTS

| | | | | |
|---|---|---|---|---|
| 3,591,956 | A | 7/1971 | Draghi | |
| 3,931,621 | A * | 1/1976 | Rose | 340/384.71 |
| 4,008,404 | A | 2/1977 | Foreman | |
| 4,022,075 | A | 5/1977 | Schuder et al. | |
| 4,035,793 | A | 7/1977 | Jennings | |
| 4,203,014 | A | 5/1980 | Harris | |
| 4,212,295 | A * | 7/1980 | Snyder | 128/886 |
| 4,363,943 | A | 12/1982 | Sorensen | |
| 4,381,432 | A | 4/1983 | Cushing | |
| 4,392,733 | A | 7/1983 | Beppu et al. | |
| 4,449,804 | A | 5/1984 | Watanabe et al. | |
| 4,490,051 | A | 12/1984 | Flaig et al. | |
| 4,632,570 | A | 12/1986 | Kelsey | |
| 5,253,228 | A | 10/1993 | Truett | |
| 5,341,127 | A * | 8/1994 | Smith | 340/604 |
| 5,365,496 | A | 11/1994 | Tolan-Samilow | |
| 5,724,021 | A | 3/1998 | Perrone | |
| 5,877,676 | A * | 3/1999 | Shankarappa | 340/309.7 |
| 5,929,747 | A * | 7/1999 | Rosenblatt et al. | 340/309.7 |
| 6,008,720 | A * | 12/1999 | Hongu et al. | 340/309.16 |
| 6,107,911 | A | 8/2000 | Perrone | |
| D455,662 | S | 4/2002 | Johnston et al. | |
| 2003/0123330 | A1 | 7/2003 | Carter et al. | |
| 2004/0263322 | A1 * | 12/2004 | Onaru et al. | 340/384.7 |

FOREIGN PATENT DOCUMENTS

GB 2246232 A * 1/1992

* cited by examiner

*Primary Examiner*—Jeffery Hofsass
*Assistant Examiner*—Hongmin Fan
(74) *Attorney, Agent, or Firm*—Williamson Intellectual Property Law, LLC; Thomas R. Williamson, III

(57) ABSTRACT

A discreet bed-wetting alarm comprising a controller, earpiece with earphone, and interconnecting cable. The controller comprises a clock/processor with timer, a display, a sound signal/tone generator, an amplifier programmed to provide an increase in sound volume level, a battery, and various input devices. A plurality of alarm time selections corresponding to known bed-wetting event times is subsequently made and a suitable alarm tone or tones is selected to awaken or alert the user. The discreet bed-wetting alarm controller and earphone may be incorporated into the earpiece for further discretion. Alternate embodiments include a vibrating alarm and/or a flashing light alarm.

20 Claims, 3 Drawing Sheets

DISCREET BED-WETTING ALARM AND METHOD OF USE THEREOF

TECHNICAL FIELD

The present invention relates generally to alarm devices, and more specifically to a private bed-wetting alarm and method of use thereof, wherein the present invention comprises an earphone for delivering an increasing volume tone until the person wearing the earphone alarm awakens, thereby enabling the person to arise and visit the lavatory.

BACKGROUND OF THE INVENTION

Many toddlers and/or other young children are often unaware that they should utilize facilities for their toilet needs and, as such, typically require encouragement or notice from their parents or other caregivers. However, as children grow older and mature, some become too embarrassed to request the guidance and/or direction of their parents/caregivers in utilizing such bathroom facilities. Such children would be less self-conscious and would visit bathroom facilities, if they had some form of discreet reminder, thereby overcoming the need to rely upon others for such direction and/or guidance.

Additionally, young children often have difficulty in awakening before their bladders become full, and, due to deep sleep, often relieve themselves in the bed while sleeping. Over time, sleep habits usually develop, wherein children awaken prior to soiling their bedclothes. However, until development of such habits, it is desirable that they have some means for awakening prior to a bed-wetting event.

Even older children may sleep deeply and be unaware of their need to relieve themselves. Thus, such older children may suffer considerable embarrassment if they soil their bedclothes, particularly when visiting and sleeping over at a friend's house.

Older adults losing their faculties may also be unaware of their need to relieve themselves, whether asleep or awake, and can become quite embarrassed when they accidentally their bedclothes and/or themselves. However, if provided with a discreet warning, they would be able to avoid such embarrassment.

Accordingly, it is highly desirable for such children and older adults to have a discreet device that can alert or awaken them so they can visit the facilities, as necessary.

In view of a recognized need for an alarm device that provides time intervals between alerts, many attempts have been made to manufacture or make a device to alert a person. For instance, U.S. Pat. No. 3,591,956 to Draghi discloses an interval timer with an audible output, having a motor-driven control cam that governs the output mechanism, enabling operations upon the completion of time intervals of irregular duration. However, Draghi '956 does not teach the utilization of a discreet headset earphone, nor progressively increasing the sound/tone level therefrom.

U.S. Pat. No. 5,365,496 to Tolan-Samilow discloses a potty trainer timepiece comprising an alarm circuit for producing an alarm signal, an alarm timer for timing an alarm interval and activating the alarm circuit, and an alarm pre-set for providing a user with means to adjust the alarm interval. Additionally, the Tolan-Samilow '496 device comprises an offset timer for selecting a delay interval and activating the alarm circuit and a delay pre-set for providing a user with means to adjust the alarm interval. A controlled event switch selects between the alarm timer and the offset timer. The device of Tolan-Samilow '496 does not teach a discreet earphone headset, nor increasing sound/tone volume level, and does not specify awakening a user during sleep periods.

U.S. Pat. No. 5,929,747 to Rosenblatt, et al. teaches a silent vibrating alarm, but does not teach the utilization of an earphone headset to sound a discreet alarm, nor the utilization of progressively louder volume of sound/tone.

U.S. Patent Application Publication No. 2003/0123330 to Carter et al. discloses an event timer having an adaptive interval for toilet training, comprising a timer for cumulatively adapting timing intervals to the needs of a particular user in response to input of potty training events. The event timer includes an input with buttons for providing user input to the adaptable timer indicating the occurrence of a potty training event. An output is connected with the adaptable timer for signaling the expiration of a timing interval, whereby the user input is utilized by the timer to adjust timing intervals based on the frequency of the occurrence of the event to more closely approximate the frequency of the occurrence of the event. The timing intervals may also be user-specified. The device of Carter et al. '330 covers a full 24-hour cycle. The device of Carter et al. '330 does not, however, teach a discreet earphone headset, nor the utilization of progressively louder sound/tone levels to awaken a heavy sleeper.

Therefore, it is readily apparent that there is a need for a discreet bed-wetting alarm and method of use thereof, providing for increasing volume of sound/tone, wherein a bed-wetting user can select appropriate time intervals for activation of an alarm to awaken the user prior to a bed-wetting event.

BRIEF SUMMARY OF THE INVENTION

Briefly described, in a preferred embodiment, the present invention overcomes the above-mentioned disadvantages and meets the recognized need for such a device by providing a discreet bed-wetting alarm and method of use thereof, wherein the alarm is audible to the user only, and wherein the sound/tone level increases to awaken the user. The user can select a plurality of appropriate alarm intervals to awaken or alert the user prior to a bed wetting or incontinent occurrence, wherein such intervals may approximate typical periods/intervals over a regular sleeping period where the user has commonly experienced bed-wetting episodes.

According to its major aspects and broadly stated, the present invention in its preferred form is a private bed-wetting alarm and method of use thereof, wherein the alarm comprises an earphone driven by an amplifier and a signal generator, and wherein the tone of the generated signal progressively increases in volume to gradually awaken a heavily-sleeping user. The alarm has a plurality of settings, which have variable intervals. The tone can also be varied to suit the user, and/or can be selectively varied to increase the likelihood of being readily noticed.

More specifically, the present invention is a discreet bed-wetting or incontinence alarm and method of use thereof, wherein the alarm comprises a controller, an earpiece with an earphone therein, and an interconnecting cable. The controller comprises a clock/processor, including multiple timers, setting buttons to select an alarm number, time of day or alarm time, hours, minutes, time delay, and tone. The present invention further comprises a display, a sound signal/tone generator, an amplifier programmed to provide an increase in sound volume level, and a battery for power. A plurality of alarm times corresponding to known bed-wetting or incontinent event times is selected, and suitable alarm tones are selected to awaken or alert the user. Alternatively, vibrating or flashing light alarms may be utilized.

The discreet bed-wetting alarm controller and earphone may be incorporated into the earpiece for further discretion, or the earpiece can communicate wirelessly with the controller, wherein the controller can be placed in a suitable unobtrusive location. The alarm may also be programmable via an external connection to a programming device such as, for exemplary purposes only, a computer.

After setting time-of-day, the user selects an alarm number and programs the time, any time delay offset from the selected alarm time, and a tone or tones suitable to alert or awaken the user. Thus, the user can be discreetly alerted or awakened, thereby avoiding embarrassing notification to others of a need to avoid incontinence.

Accordingly, a feature and advantage of the present invention is its ability to notify and/or awaken the user privately, so that others are unaware of the utilization of the device of the present invention.

Another feature and advantage of the present invention is its ability to awaken heavy sleepers by increasing the volume level of the alarm.

An additional feature and advantage of the present invention is the ability to change the tone thereof to suit the user, and/or to provide pre-selected variability of tone.

Still another feature and advantage of the present invention is its ability to fit comfortably upon the body of the user.

Yet another feature and advantage of the present invention is its ability to be programmed to provide alarms at a multitude of variable intervals.

Yet still another feature and advantage of the present invention is that it helps prevent bed-wetting by awakening the user prior to the typical pattern of bed-wetting events.

A further feature and advantage of the present invention is its discreet, small size, thereby reducing the likelihood of being noticed by others.

These and other features and advantages of the present invention will become more apparent to one skilled in the art from the following description and claims when read in light of the accompanying drawings.

BRIEF DESCRIPTION OF THE DRAWINGS

The present invention will be better understood by reading the Detailed Description of the Preferred and Selected Alternate Embodiments with reference to the accompanying drawing figures, in which like reference numerals denote similar structure and refer to like elements throughout, and in which.

DETAILED DESCRIPTION OF THE PREFERRED AND SELECTED ALTERNATIVE EMBODIMENTS

In describing the preferred and selected alternate embodiments of the present invention, as illustrated in FIGS. 1–4, specific terminology is employed for the sake of clarity. The invention, however, is not intended to be limited to the specific terminology so selected, and it is to be understood that each specific element includes all technical equivalents that operate in a similar manner to accomplish similar functions.

Figure 1:
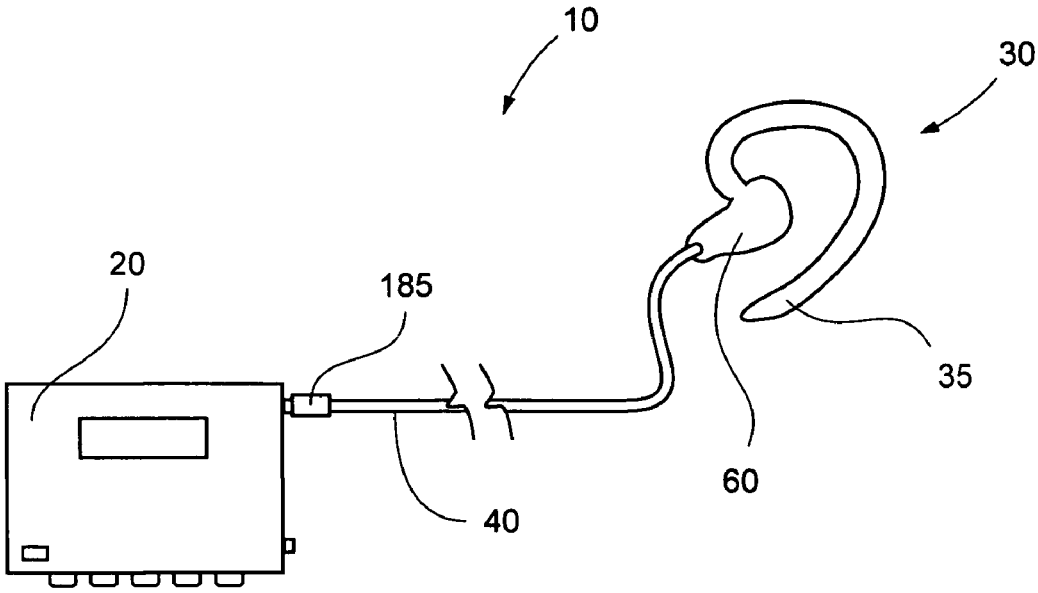
FIG. 1 is a partial perspective view of a discreet bed-wetting alarm according to a preferred embodiment of the present invention.
Figure 2:
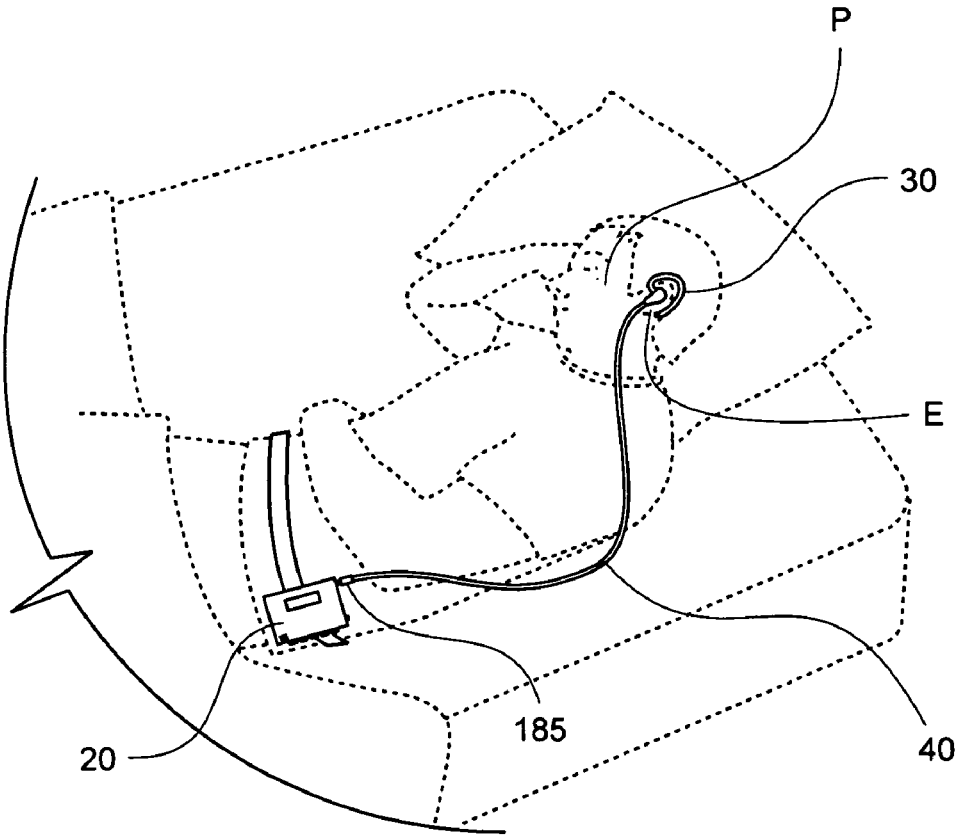
FIG. 2 is a perspective view of a discreet bed-wetting alarm according to a preferred embodiment of the present invention, shown in use.
Figure 3:
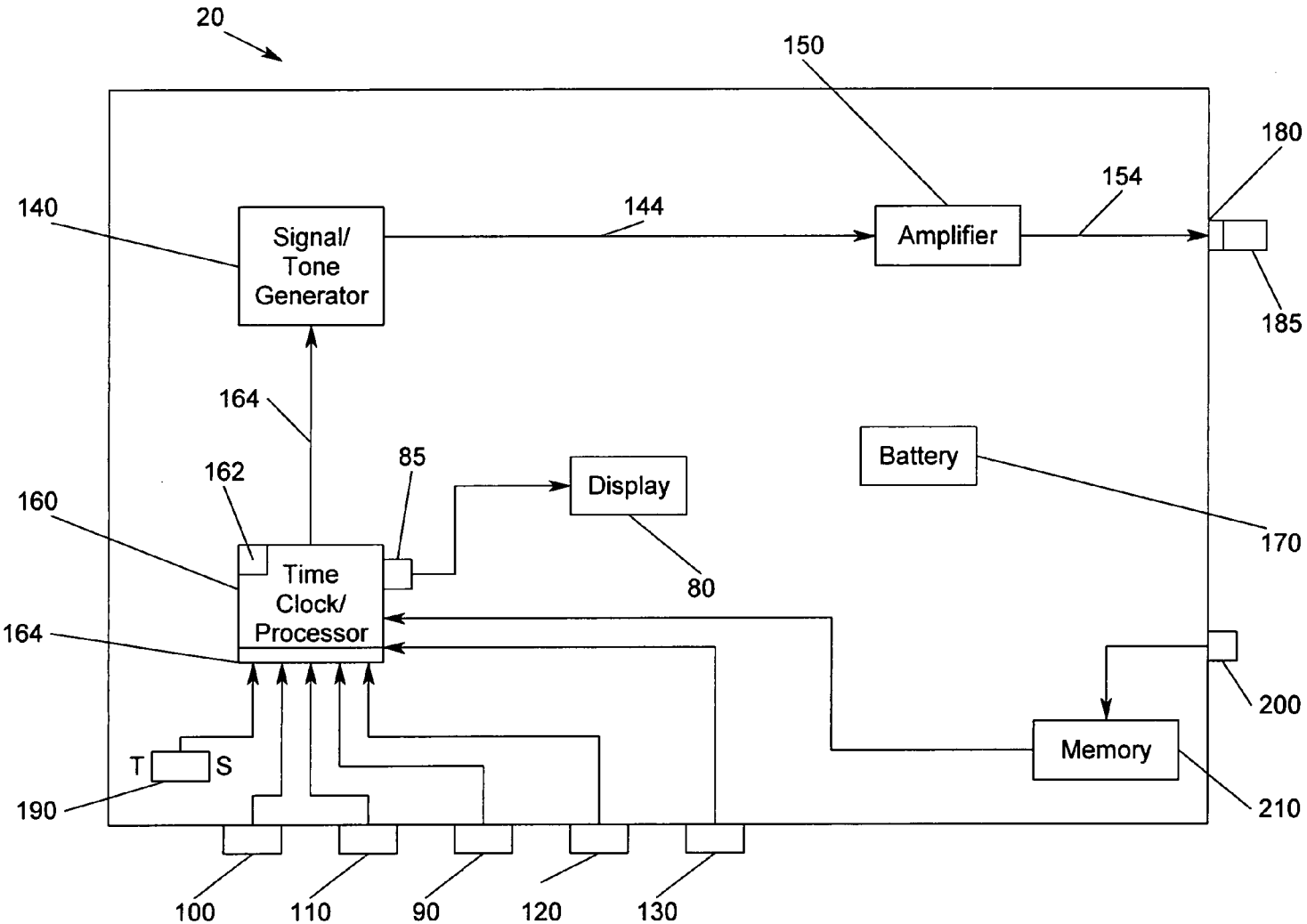
FIG. 3 is a layout diagram of a discreet bed-wetting alarm according to a preferred embodiment of the present invention.

Referring now to FIGS. 1–3, the present invention in a preferred embodiment is discreet bed-wetting alarm 10, wherein discreet bed-wetting alarm 10 preferably comprises controller 20, earpiece 30 and cable 40.

Controller 20 preferably comprises clock/processor 160, sound signal/tone generator 140, amplifier 150, battery 170, selector 190, jack 180, display 80, alarm number button 90, hour set button 100, minute set button 110, delay interval set button 120 and tone set button 130, and associated electronic circuitry as is generally known by those skilled in the art.

Earpiece 30 preferably comprises earphone 60 and retainer 35, as is generally known to those skilled in the art. Cable 40 is preferably in electrical communication with earpiece 30 and is preferably in removable electrical communication with controller 20 via plug 185 and jack 180.

Battery 170 preferably is in electrical communication with, and provides power for, clock/processor 160, signal/tone generator 140, amplifier 150 and display 80. In a selected alternate embodiment, battery 170 further provides power to memory 210.

Referring now more specifically to FIG. 3, clock/processor 160 preferably comprises integral timer 162, alarm and setting circuitry 164, and display output means 85 for driving time display 80. Time is preferably set in clock/processor 160 via hour set button 100 and minute set button 110, wherein time/alarms selector 190 is preferably set to time position T and hours are preferably set by depressing and/or holding hour set button 100. Similarly, depressing minute set button 110 preferably sets minutes.

Alarm times are preferably set by placing time/alarm selector 190 in alarm position A. A tone is preferably selected via tone button 130 from a range of suitably pleasing to raucous alarm tones. One of a plurality of alarms is subsequently preferably selected via alarm number button 90. Hours and minutes for the selected alarm number are preferably set by depressing hour set button 100 and/or minute set button 110, as set forth hereinabove. Additional alarms are preferably set by selection of another alarm number via alarm number button 90 and subsequent time is set via hour set button 100 and minute set button 110, as set forth hereinabove.

Having previously set time, person P preferably selects a suitable tone and an appropriate awakening alarm time, and subsequently preferably inserts ear piece 30 into ear E. Person P subsequently preferably inserts plug 185 into jack 180 of controller 20, thereby placing ear piece 30 and controller 20 in electrical communication with one another.

Person P may wish for an alarm to be activated after a delay period, which period is then preferably added to the alarm time in order to activate the alarm at a delayed time. A delay interval is preferably selected via delay interval set button 120 using hour set button 100 and minute set button 110 for setting the amount of delay.

Upon reaching a selected time, clock/processor 160 preferably sends a signal via 164 to sound signal/tone generator 140, wherein sound signal/tone generator 140 preferably generates a pre-selected tone and sends same via 144 to amplifier 150. Amplifier 150 is preferably programmed to provide a progressively increasing volume of the selected tone. Sound tone generated via sound signal/tone generator 140 is preferably suitably amplified via amplifier 150 and preferably sent via 154 to jack 180, wherein plug 185 has preferably previously been inserted into jack 180. Plug 185 is preferably in electrical communication with cable 40, wherein cable 40 preferably passes tone to earphone 60, thereby awakening person P at a suitable time to prevent a bed-wetting event.

Figure 4:
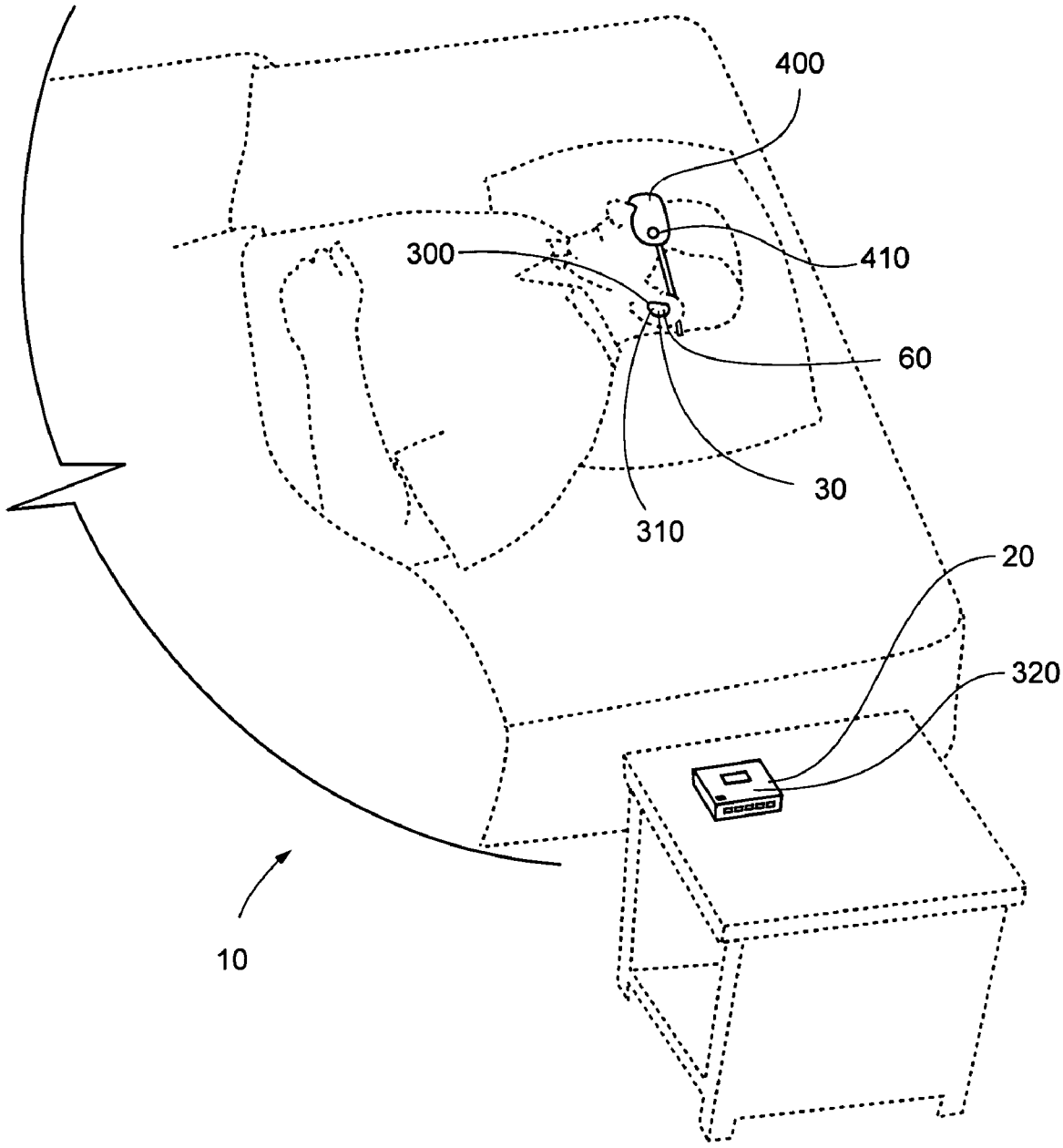
FIG. 4 is a perspective view of a discreet bed-wetting alarm according to an alternate embodiment of the present invention, shown in use.

Referring now more specifically to FIG. 4, illustrated therein is an alternate embodiment of discreet bed-wetting alarm 10, wherein the alternate embodiment of FIG. 4 is substantially equivalent in form and function to that of the preferred embodiment detailed and illustrated in FIGS. 1–3 except as hereinafter specifically referenced. Specifically, the embodiment of FIG. 4 comprises ear alarm 300, wherein ear alarm 300 comprises earpiece 30 with earphone 60 therein. Controller 20 is in wireless communication with ear alarm 300, wherein controller comprises transmitter 320 and ear alarm 300 comprises receiver 310. Controller 20 sends a wireless signal to ear alarm 300, thereby alarming person P in a timely fashion to avoid a bed-wetting or incontinent event.

It is envisioned in an alternate embodiment of the present invention that discreet bed-wetting alarm 10, could comprise controller 20 and further, that earphone 60 could be entirely contained within earpiece 30, thereby being even more discreet.

It is envisioned in an alternate embodiment of the present invention that discreet bed-wetting alarm 10 could be programmable via connection 200 to a computer or other setting device, wherein connection 200 could be wired or wireless. In this embodiment, discreet bed-wetting alarm 10 could include programmable memory device 210.

It is envisioned in another alternate embodiment of the present invention that person P could select a preferred tone, or could select a combination of distinguishably-different tones that could be activated in a warbling fashion to alert person P to proximity of a bed-wetting event.

It is envisioned in still another alternate embodiment of the present invention that discreet bed-wetting alarm 10 could comprise a vibrating alarm.

It is envisioned in yet another alternate embodiment of the present invention that discreet bed-wetting alarm 10 could comprise flashing light receiver 410 (best shown in FIG. 4) to facilitate utilization of discreet bed-wetting alarm 10 in darkness, or within sleep mask 400. Flashing light receiver 410 could activate by flashing upon receipt of a signal from controller 20, or in an alternate embodiment, controller 20 could be contained within flashing light receiver 410.

It is contemplated in still yet another alternate embodiment of the present invention that at least two tones could be selectable for an alarm, wherein sound signal/tone generator 140 could alternate between the tones.

The foregoing description and drawings comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings presented in the foregoing descriptions and the associated drawings. Although specific terms may be employed herein, they are used in a generic and descriptive sense only and not for purposes of limitation. Accordingly, the present invention is not limited to the specific embodiments illustrated herein, but is limited only by the following claims.

What is claimed is:

1. A private bed-wetting alarm comprising:
   - a means for communicating an alarm discreetly, wherein said means for communicating an alarm discreetly comprises a flashing light, and wherein said flashing light is disposed within a sleep mask;
   - a programmable timer, wherein said programmable timer comprises a means for setting time and a plurality of variable alarm time intervals;
   - a plurality of variable alarm time intervals to awaken or alert a user prior to bed wetting incontinent occurrences, wherein said plurality of variable alarm time intervals comprises typical intervals over a regular sleeping period wherein the user has commonly experienced said bed wetting incontinent occurrences; and
   - an alarm sound tone generator.

2. The private bed-wetting alarm of claim 1, further comprising an alarm sound amplifier.

3. The private bed-wetting alarm of claim 1, wherein said means for communicating an alarm discreetly further comprises an earphone.

4. The private bed-wetting alarm of claim 1, wherein said alarm sound tone generator comprises a means for selecting alarm tones.

5. The private bed-wetting alarm of claim 1, wherein said means for setting time and a plurality of alarm time intervals comprises a delay period, and wherein said alarm is activated after said delay period.

6. The private bed-wetting alarm of claim 1, wherein said alarm sound tone generator is programmable.

7. The private bed-wetting alarm of claim 1, wherein said alarm sound tone generator and said programmable timer are programmed via an external means for setting.

8. The private bed-wetting alarm of claim 1, wherein said means for communicating an alarm discreetly further comprises a vibrator.

9. The private bed-wetting alarm of claim 2, wherein said alarm sound amplifier is adapted to provide a progressively increasing sound volume level.

10. The private bed-wetting alarm of claim 1, wherein said alarm sound tone generator is adapted to provide at least one tone.

11. The private bed-wetting alarm of claim 10, wherein said at least one tone comprises at least two tones.

12. The private bed-wetting alarm of claim 11, wherein said at least two tones are alternately selected in a warbling fashion.

13. A method of discreetly awakening a person, said method comprising the steps of:
   - a. obtaining a private bed-wetting alarm comprising a means for communicating an alarm discreetly, a programmable timer, a sound tone generator and a sound amplifier, wherein said means for communicating an alarm discreetly comprises a flashing light disposed within a sleep mask.;
   - b. setting alarm times; and
   - c. setting alarm intervals, wherein said alarm intervals comprise typical intervals over a regular sleeping period during which a user has commonly experienced bed wetting incontinent occurrences.

14. The method of claim 13, further comprising the step of:

d. selecting at least one tone.

15. The method of claim 13, further comprising the step of:

e. providing said private bed-wetting alarm to a user prior to the user entering a sleeping state.

16. The method of claim 13, wherein said means for communicating an alarm, said programmable timer, said sound tone generator and said sound amplifier are contained within an earpiece.

17. The method of claim 13, wherein said steps of setting alarm times and setting alarm intervals are carried out via a computer.

18. A bed-wetting alarm comprising:

a means for communicating an alarm discreetly, wherein said means for communicating an alarm discreetly comprises a flashing light disposed within a sleep mask.

19. The bed-wetting alarm of claim 18, further comprising a means for setting typical alarm intervals over a regular sleeping period during which a user has commonly experienced bed wetting incontinent occurrences.

20. The bed-wetting alarm of claim 19, further comprising a means for wireless communicating between said means for setting typical alarm intervals and a controller, wherein said controller comprises a programmable timer.

* * * * *